US007661903B1

(12) United States Patent
Maroschak et al.

(10) Patent No.: US 7,661,903 B1
(45) Date of Patent: Feb. 16, 2010

(54) LOW-PRESSURE DOSING SYSTEM FOR SEWAGE DISPOSAL AND ASSOCIATED METHODS

(75) Inventors: Michael D. Maroschak, Apopka, FL (US); Douglas G. Everson, Tavares, FL (US); Marc H. Maroschak, Orlando, FL (US); Scott M. Thomson, Lake Mary, FL (US)

(73) Assignee: Plastic Tubing Industries, Inc., Orlando, FL (US)

( * ) Notice: Subject to any disclaimer, the term of this patent is extended or adjusted under 35 U.S.C. 154(b) by 58 days.

(21) Appl. No.: 12/055,435

(22) Filed: Mar. 26, 2008

Related U.S. Application Data

(60) Provisional application No. 60/911,964, filed on Apr. 16, 2007.

(51) Int. Cl.
*E02B 11/00* (2006.01)

(52) U.S. Cl. ..... 405/43; 405/49

(58) Field of Classification Search ..... 405/43–50, 405/52, 53

See application file for complete search history.

(56) References Cited

U.S. PATENT DOCUMENTS

| | | | | |
|---|---|---|---|---|
| 2,366,522 | A | 1/1945 | Gutman | |
| 3,060,693 | A | 10/1962 | Taylor | |
| 3,403,519 | A | 10/1968 | Balko | |
| 3,441,140 | A | 4/1969 | Thurber | |
| 3,698,195 | A | 10/1972 | Chapin | |
| 3,830,373 | A * | 8/1974 | Sixt | 405/49 |
| 4,019,326 | A | 4/1977 | Herveling et al. | |
| 4,113,818 | A * | 9/1978 | Drossbach | 405/49 |
| 4,134,268 | A | 1/1979 | Elmore | |
| 4,188,154 | A | 2/1980 | Izatt | |
| 4,246,305 | A | 1/1981 | Delattre | |
| 4,490,072 | A * | 12/1984 | Glasser | 405/45 |
| 4,588,325 | A | 5/1986 | Seefert | |
| 4,799,822 | A | 1/1989 | Wintermantel et al. | |
| 4,824,287 | A | 4/1989 | Tracy | |
| 4,904,112 | A | 2/1990 | McDonald | |
| 4,907,385 | A | 3/1990 | Biodrowski | |
| 4,950,103 | A | 8/1990 | Justice | |

(Continued)

FOREIGN PATENT DOCUMENTS

| | | |
|---|---|---|
| GB | 2040151 | 8/1980 |

(Continued)

*Primary Examiner*—Frederick L Lagman
(74) *Attorney, Agent, or Firm*—Allen, Dyer, Doppelt, Milbrath & Gilchrist, P.A.

(57) ABSTRACT

A drain field assembly includes a distribution pipe for receiving liquid effluent that has a plurality of holes through the wall. A plurality of generally cylindrical void pipes receive effluent from the distribution pipe, retaining the effluent for a time, and distributing the effluent to an area of soil. The void pipes are positioned in a trench atop one another so that the cylindrical axis of a bottom void pipe is substantially vertically aligned with the cylindrical axis of a top void pipe, and the cylindrical axis of a middle void pipe is offset from those of the bottom and top void pipes. A distribution pipe is positioned within the top void pipe. In some embodiments a second distribution pipe can be positioned atop the top void pipe. A protective soil-impervious, liquid-permeable sheeting is placed atop and beneath the assembly for protecting the holes pipes from intrusion by soil.

11 Claims, 2 Drawing Sheets

U.S. PATENT DOCUMENTS

| | | | | |
|---|---|---|---|---|
| 5,015,123 | A | 5/1991 | Houck et al. | |
| 5,074,708 | A | 12/1991 | McCann, Sr. | |
| 5,087,151 | A | 2/1992 | DiTullio | |
| 5,378,357 | A | 1/1995 | Houck et al. | |
| 5,516,229 | A | 5/1996 | Atchley et al. | |
| 5,520,481 | A | 5/1996 | Atchley et al. | |
| 5,913,635 | A * | 6/1999 | Graham | 405/43 |
| 6,461,078 | B1 * | 10/2002 | Presby | 405/49 |
| 6,702,517 | B2 * | 3/2004 | Goddard | 405/45 |
| 7,022,235 | B2 * | 4/2006 | Hassett | 405/43 |
| 7,309,423 | B1 * | 12/2007 | Branz | 405/43 |
| 2004/0253054 | A1 * | 12/2004 | Atchley | 405/49 |
| 2006/0078387 | A1 * | 4/2006 | Allard et al. | 405/45 |
| 2006/0222460 | A1 * | 10/2006 | Lloyd | 405/49 |
| 2006/0280557 | A1 * | 12/2006 | Ring et al. | 405/43 |

FOREIGN PATENT DOCUMENTS

| | | |
|---|---|---|
| SU | 1069720 | 1/1984 |
| SU | 1442605 | 7/1988 |

* cited by examiner

LOW-PRESSURE DOSING SYSTEM FOR SEWAGE DISPOSAL AND ASSOCIATED METHODS

CROSS-REFERENCE TO RELATED APPLICATION

This application claims priority to provisional application Ser. No. 60/911,964, filed Apr. 16, 2008.

BACKGROUND OF THE INVENTION

1. Field of the Invention

The present invention relates to sewage disposal systems and, more particularly, to an improved drain field system using multiple corrugated drain pipes.

2. Description of Related Art

Traditional sewage systems, such as those used for disposing waste from homes that are not connected to sewer lines, typically comprise a concrete, plastic, or steel septic tank into which both solid and liquid waste flow. The tank has one or more compartments through which the sewage flows horizontally and is kept out of contact with the air for a minimum of 24 hours. Spontaneous biological action liquefies much of the organic matter, while fine particles settle to the bottom, where bacteria convert some of the organic matter into methane and carbon dioxide. The solid matter either decomposes or is periodically pumped out of the tank.

The liquid flows out of the septic tank through a perforated pipe surrounded by loose aggregate, usually a bed of rock or gravel. The soil itself then continues the filtering process, and the liquid ultimately returns to the ground water.

The installation of such sewage systems entails digging a trench into which is poured aggregate in the form of rock, crushed stone, or gravel. The perforated pipe is then laid down on the aggregate, and additional aggregate is added to a required depth. The top layer consists of soil cover, preferably planted, to facilitate surface water runoff.

Conventional systems require a considerable amount of skilled labor and expensive materials. The installations must meet stringent state and local codes, and must often take place in difficult terrain. For instance, suitable fill material is often difficult to obtain, since the aggregate must meet size and cleanliness requirements.

An additional problem with currently used systems is that the aggregate material, being of nonuniform sizes, has variable properties with regard to retention and evenness of distribution. The aggregate is capable of sealing off with sewage material, which prevents further filtration at such sealed off sites.

Another problem with conventional systems is that the perforated pipe through which the fluid exits the septic tank is typically buried 2 feet beneath the surface. This depth can both hinder evapotranspiration of liquids into the atmosphere and can also cause backup with as little as 10 inches of rainfall, depending on the soil and water table conditions.

The assignee of the present invention has also disclosed in U.S. Pat. Nos. 5,516,229 and 5,520,481 the use of assemblies of stacked void and distribution pipes in a plurality of configurations for use without aggregate.

SUMMARY OF THE INVENTION

The present invention is directed to a drain field assembly having a top edge and a bottom edge. The drain field assembly is positionable in a trench in an area of soil. The drain field assembly comprises a distribution pipe that is configured for receiving effluent from a sewage disposal system into an inlet at a first end. The distribution pipe has a longitudinal axis, a wall defining an interior space, and a plurality of holes through the wall into the interior space. In one embodiment a second end opposed to the first end is capped.

The drain field assembly further comprises a plurality of void pipes for receiving effluent from the distribution pipe holes, retaining the effluent for a time, and distributing the effluent to the area of soil surrounding the trench. Each void pipe has a longitudinal axis, a wall defining an inner space, and a plurality of holes through the wall into the inner space. The void pipes are positioned relative to one another so that a top void pipe is above a bottom void pipe, and the distribution pipe is positioned within the inner space of the top void pipe. In an alternate embodiment each void pipe also comprises a plurality of slots through the wall that are smaller than the holes. In an embodiment, the void pipe and the distribution pipe have similar constructions.

The drain field assembly has a configuration that includes a plurality of void pipes positioned in a trench atop one another. By "atop" is meant in decreasing distances from the top edge, and not necessarily directly atop one another. In an example wherein three void pipes are used, the void pipes may be positioned so that the longitudinal axis of a bottom-most void pipe is substantially vertically aligned with the longitudinal axis of the top void pipe, and the cylindrical axis of a middle void pipe is offset from those of the bottom and top void pipes.

At least one distribution pipe is positioned within the top void pipe, which obviously has a diameter smaller than that of the top void pipe. In some embodiments a second distribution pipe can be positioned atop the top void pipe.

In use a protective soil-impervious, liquid-permeable sheeting is placed atop the top edge and beneath the assembly for protecting the holes (and slots, if present) in the distribution pipe and the void pipes from intrusion by soil.

A drain field of the present invention comprises the drain field assembly as described above situated in a generally rectangular trench with a bottom edge adjacent a bottom of the trench and covered over with backfill material or sand. In operation, the distribution pipe receives liquid effluent from a sewage disposal system, usually a septic tank, through the inlet at the first end. The effluent is then distributed via the distribution pipe to the top void pipe, and thence to middle, if present, and bottom void pipes, wherein it is retained until permitted to escape via the holes (and slots, if present).

The features that characterize the invention, both as to organization and method of operation, together with further objects and advantages thereof, will be better understood from the following description used in conjunction with the accompanying drawing. It is to be expressly understood that the drawing is for the purpose of illustration and description and are not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
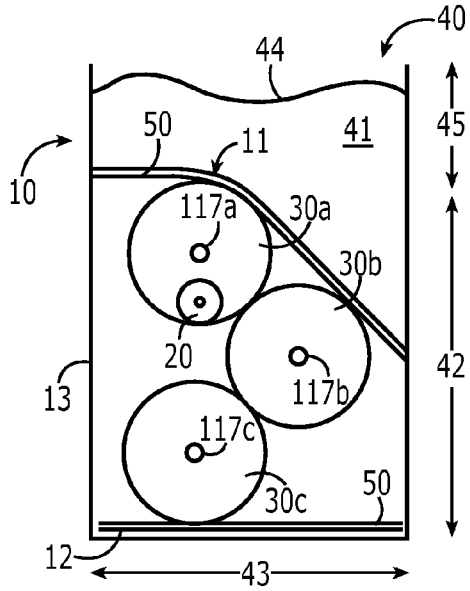
FIG. 1 is a cross-sectional view of the assembly of pipes situated in a trench.

A description of the preferred embodiments of the present invention will now be presented with reference to FIGS. 1-5B.

The drain field assemblies 10,10' (FIGS. 1 and 2, respectively) disclosed herein each have a top edge 11,11', a bottom edge 12,12', and two sides 13,13', an inlet end 14, and a downstream end 15 opposed to the inlet end 14 (FIG. 3), for use with a sewage disposal system.

Figure 3:
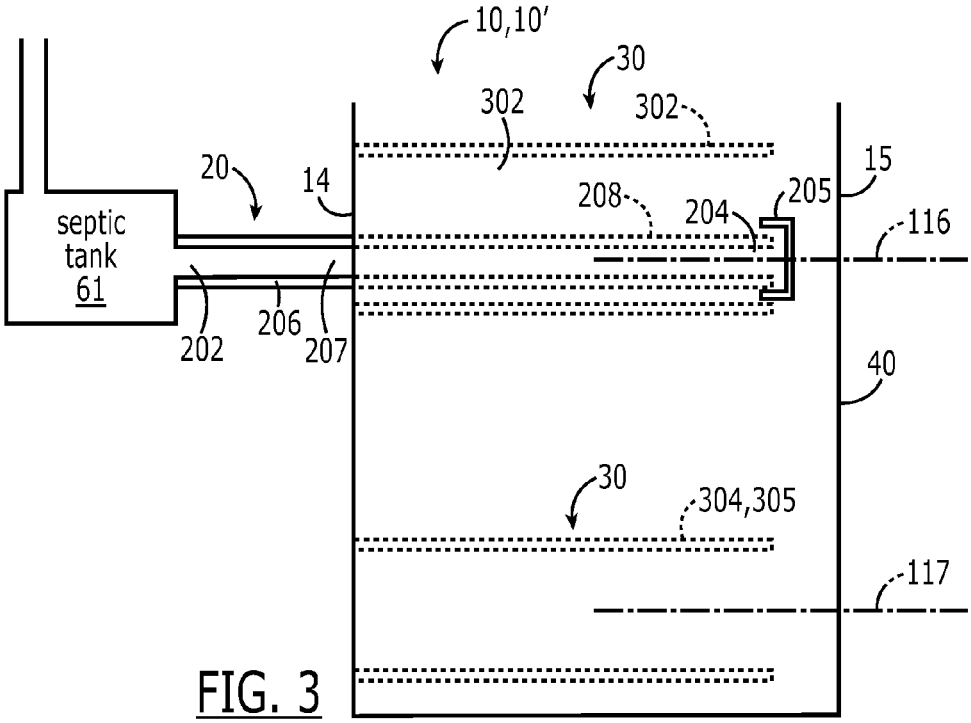
FIG. 3 is a horizontal cross-sectional view of a drain field installation of the present invention.
Figure 4A:
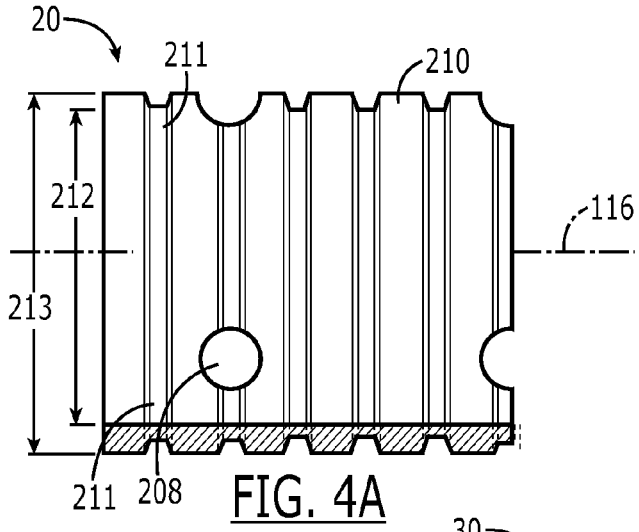
FIGS. 4A,4B are side perspective views of a distribution pipe (FIG. 4A) and a void pipe (FIG. 4B).
Figure 4B:
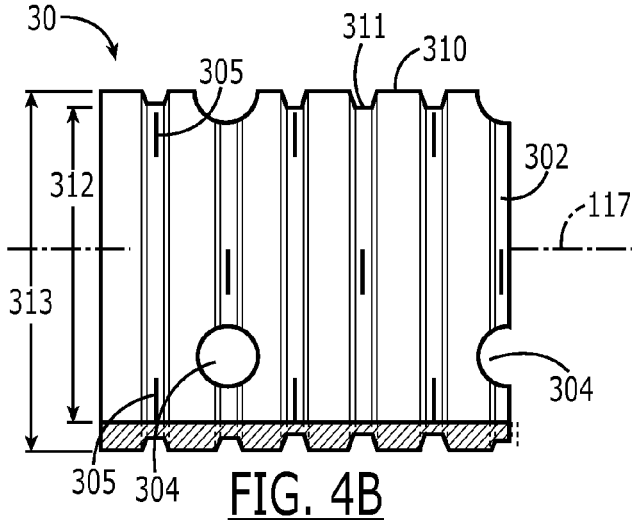
Figure 5A:
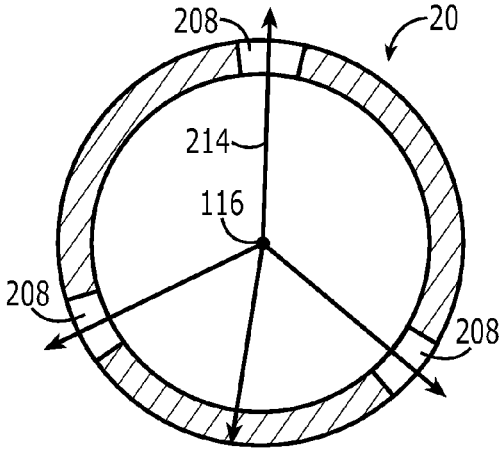
FIGS. 5A and 5B are axial cross-sectional views of the distribution pipe (FIG. 5A) and void pipe (FIG. 5B).
Figure 5B:
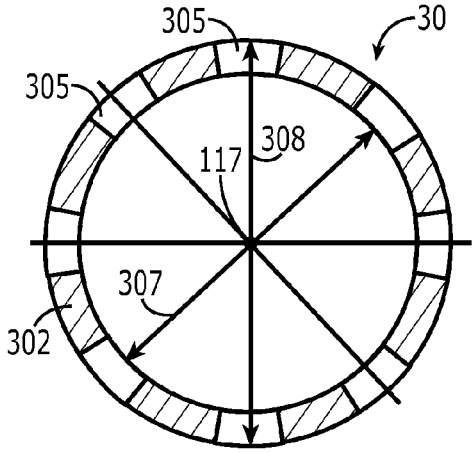

The assembly 10,10' in a particular embodiment comprises at least one generally cylindrical distribution pipe 20 for receiving liquid effluent from the sewage disposal system. The side cross-sectional view in FIG. 3 depicts an inlet at a first end 202, a second, downstream end 204 opposed to the inlet end 202, a longitudinal axis 116, and a wall 206 defining an interior space 207. In the embodiment shown, the distribution pipe 20 further comprises a generally cylindrical cap 205 dimensioned to closely engage the second end 204 for preventing liquid effluent from escaping out therefrom and for preventing soil from entering thereinto. Holes 208 extending into the interior space 207 are disposed along the distribution pipe 20 (FIGS. 4A and 5A).

The assembly 10,10' also comprises a plurality of void pipes 30 for receiving effluent from the distribution pipe 20, retaining the effluent for a time, and distributing the effluent to an area of soil. Each void pipe 30, shown in FIGS. 4B and 5B, in a particular embodiment comprises a generally cylindrical pipe that has a longitudinal axis 117, a wall 302 defining an inner space 306, and a plurality of holes 304 and slots 305 extending through the wall 302 and into the inner space 306. Slots 305 are smaller than holes 304. The void pipes 30 have an inner diameter 307 and an outer diameter 308.

In a particular embodiment, distribution pipe 20 and void pipes 30 comprise corrugated pipes, each having a series of ridged sectors 210,310 interspersed with valley sectors 211, 311, the valley sectors 211,311 having an interior diameter 212,312 smaller than an interior diameter 213,313 of the ridged sectors 210,310. In this embodiment, the slots 305 in the void pipes 30 are positioned within valley sectors 311.

Figure 2:
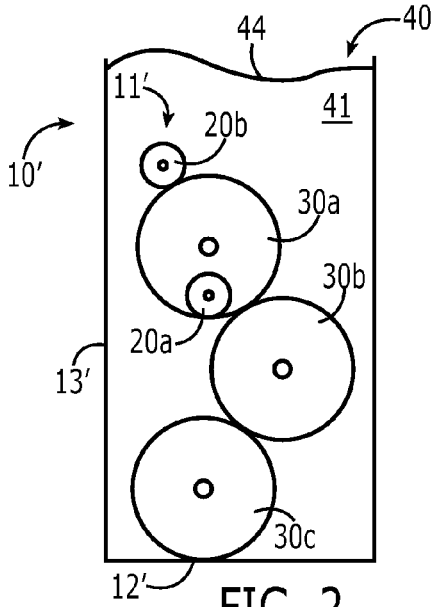
FIG. 2 is a cross-sectional view of an alternate embodiment of an assembly of pipes situated in a trench.

The present invention in the configurations 10,10' shown in FIGS. 1 and 2 includes a plurality of void pipes 30 positioned in a trench 40 atop, but not vertically aligned with, one another. In an example wherein three void pipes 30*a*-30*c* are used, the void pipes 30*a*-30*c* may be positioned so that the longitudinal axis 117*c* of a bottom void pipe 30*c* is substantially vertically aligned with the longitudinal axis 117*a* of a top void pipe 30*a*, and a middle void pipe 30*b* is positioned between the top 30*a* and bottom 30*c* void pipes with a longitudinal axis 117*b* offset from, and vertically intermediate, those 117*c*,117*a* of the bottom 30*c* and top 30*a* void pipes, respectively.

In a first embodiment 10 (FIG. 1), one distribution pipe 20 is positioned within the top void pipe 30*a*, which has an outer diameter 214 smaller than the inner diameter 307 of the top void pipe 30*a*, and is preferably significantly smaller.

In a second embodiment 10' (FIG. 2), a first distribution pipe 20*a* is positioned as for the embodiment 10 discussed above, and a second distribution pipe 20*b* is positioned atop and vertically offset from the top void pipe 30*a* and the first distribution pipe 20*a*.

In use a protective soil-impervious, liquid-permeable sheeting 50 is placed atop the top edge 11,11' and beneath the bottom edge 12,12' of the assembly 10,10' for protecting the holes 208 in the distribution pipe 20 and the holes 304 and slots 305 in the void pipes 30 from intrusion by soil. In a preferred embodiment, protective sheeting 50 comprises a spun-bonded, nonwoven fabric. Such fabrics may include nylon or polyester. In a preferred embodiment a fabric known as Tile guard (Remay™, Style 2005 or 2015, DuPont, Wilmington, Del.) can be used, although this is not intended as a limitation.

The drain field 60 of the present invention comprises the drain field assembly 10,10' as described above situated in a generally rectangular trench 40 with its bottom edge 11,11' facing downward and covered over with backfill material or sand 41. The trench 40, for void pipes 30 having an outer diameter 308 of 4.625 in., can have a depth 42 of 13.2-13.5 in. and a width 43 of 6 in. The assembly 10,10' can be submerged beneath the surface 44 by a total depth 45 of approximately 21.5 in. in a particular embodiment.

In operation, the distribution pipe 20 receives liquid effluent from a sewage disposal system, usually a septic tank or dose tank 61, through its inlet 202 at the first end. The effluent is then distributed via the distribution pipe 20 to the top void pipe 30*a*, and thence to the middle 30*b* and bottom 30*c* void pipes, wherein it is retained until permitted to escape via the holes 304 and slots 305.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the system illustrated and described herein are by way of example, and the scope of the invention is not limited to the exact details of construction and use.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A drain field assembly having a top edge and a bottom edge and positionable in a trench in an area of soil, the drain field assembly comprising:

a distribution pipe configured for receiving effluent from a sewage disposal system into an inlet at a first end, the distribution pipe having a longitudinal axis, a wall defining an interior space, and a plurality of holes through the wall into the interior space;

a plurality of void pipes for receiving effluent from the distribution pipe holes, retaining the effluent for a time, and distributing the effluent to the area of soil surrounding the trench, each void pipe having a longitudinal axis, a wall defining an inner space, and a plurality of holes through the wall into the inner space, the void pipes positioned relative to one another so that a top void pipe is above a bottom void pipe, the distribution pipe positioned within the inner space of the top void pipe; and wherein the distribution pipe comprises a first distribution pipe and a second distribution pipe configured for receiving effluent from a sewage disposal system into an inlet at a first end, the second distribution pipe having a longitudinal axis, a wall defining an interior space, and a plurality of holes through the wall into the interior space, the second distribution pipe positioned atop and vertically offset from the top void pipe and the first distribution pipe.

2. The drain field assembly recited in claim 1, further comprising a cap dimensioned for closely engage the distribution pipe at a second, downstream end opposed to the first end, for preventing effluent from escaping therefrom and for preventing external material from entering thereinto.

3. The drain field assembly recited in claim 1, wherein the void pipes further have a plurality of slots through the wall into the inner space, the slots smaller than the holes.

4. The drain field assembly recited in claim 1, wherein the distribution pipe and the void pipes all comprise corrugated pipes having a series of ridged sectors interspersed with valley sectors, the valley sectors having an interior diameter smaller than an interior diameter of the ridged sectors.

5. The drain field assembly recited in claim 4, wherein the void pipes further have a plurality of slots through the wall in a ridged sector into the inner space, the slots smaller than the holes.

6. The drain field assembly recited in claim 1, wherein the plurality of void pipes comprise three void pipes, the longitudinal axis of the top void pipe substantially vertically aligned with the longitudinal axis of the bottom void pipe, a middle void pipe positioned vertically between the top and the bottom pipe, the longitudinal axis of the middle pipe vertically offset from the longitudinal axes of the top and the bottom void pipes.

7. The drain field assembly recited in claim 1, wherein an outer diameter of the distribution pipe is substantially smaller than an inner diameter of the top void pipe.

8. A drain field comprising:

a trench in an area of soil; and a drain field assembly positionable within the trench, the drain field assembly having a top edge and a bottom edge, the drain field assembly comprising:

a distribution pipe configured for receiving effluent from a sewage disposal system into an inlet at a first end, the distribution pipe having a longitudinal axis, a wall defining an interior space, and a plurality of holes through the wall into the interior space;

a plurality of void pipes for receiving effluent from the distribution pipe holes, retaining the effluent for a time, and distributing the effluent to the area of soil surrounding the trench, each void pipe having a longitudinal axis, a wall defining an inner space, and a plurality of holes through the wall into the inner space, the void pipes positioned relative to one another so that a top void pipe is above a bottom void pipe, the distribution pipe positioned within the inner space of the top void pipe; and wherein the distribution pipe comprises a first distribution pipe and a second distribution pipe configured for receiving effluent from a sewage disposal system into an inlet at a first end, the second distribution pipe having a longitudinal axis, a wall defining an interior space, and a plurality of holes through the wall into the interior space, the second distribution pipe positioned atop and vertically offset from the top void pipe and the first distribution pipe.

9. The drain field recited in claim 8, further comprising a liquid-impervious sheeting positioned in the trench beneath the drain field assembly and above the drain field assembly.

10. A method of constructing a drain field comprising:

digging a trench in an area of soil; and positioning a drain field assembly within the trench, the drain field assembly having a top edge and a bottom edge, the drain field assembly comprising:

a distribution pipe configured for receiving effluent from a sewage disposal system into an inlet at a first end, the distribution pipe having a longitudinal axis, a wall defining an interior space, and a plurality of holes through the wall into the interior space;

a plurality of void pipes for receiving effluent from the distribution pipe holes, retaining the effluent for a time, and distributing the effluent to the area of soil surrounding the trench, each void pipe having a longitudinal axis, a wall defining an inner space, and a plurality of holes through the wall into the inner space, the void pipes positioned relative to one another so that a top void pipe is above a bottom void pipe, the distribution pipe positioned within the inner space of the top void pipe; and wherein the distribution pipe comprises a first distribution pipe, and a second distribution pipe configured for receiving effluent from a sewage disposal system into an inlet at a first end, the second distribution pipe having a longitudinal axis, a wall defining an interior space, and a plurality of holes through the wall into the interior space, the second distribution pipe positioned atop and vertically offset from the top void pipe and the first distribution pipe.

11. The method recited in claim 10, further comprising positioning a liquid-impervious sheeting in the trench beneath the drain field assembly and above the drain field assembly.

* * * * *